US010837078B2

(12) United States Patent
Ueno et al.

(10) Patent No.: US 10,837,078 B2
(45) Date of Patent: Nov. 17, 2020

(54) STEEL SHEET, METHOD OF MANUFACTURING SAME, CROWN CAP, AND DRAWING AND REDRAWING (DRD) CAN

(71) Applicant: JFE STEEL CORPORATION, Tokyo (JP)

(72) Inventors: Takashi Ueno, Tokyo (JP); Nobusuke Kariya, Tokyo (JP); Katsumi Kojima, Tokyo (JP); Yoshihide Yamamoto, Tokyo (JP); Akihiro Katagiri, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/489,861

(22) PCT Filed: Mar. 28, 2018

(86) PCT No.: PCT/JP2018/012697
§ 371 (c)(1),
(2) Date: Aug. 29, 2019

(87) PCT Pub. No.: WO2018/181449
PCT Pub. Date: Oct. 4, 2018

(65) Prior Publication Data

US 2020/0010920 A1 Jan. 9, 2020

(30) Foreign Application Priority Data

Mar. 31, 2017 (JP) ..... 2017-071544

(51) Int. Cl.
*C21D 9/46* (2006.01)
*C22C 38/06* (2006.01)
(Continued)

(52) U.S. Cl.
CPC ..... *C21D 9/46* (2013.01); *B65D 41/12* (2013.01); *C21D 8/0205* (2013.01);
(Continued)

(58) Field of Classification Search
None
See application file for complete search history.

(56) References Cited

U.S. PATENT DOCUMENTS 7,501,031 B2 3/2009 Takeuchi et al.
2013/0248060 A1 9/2013 Maruyama et al.
(Continued)

FOREIGN PATENT DOCUMENTS

EP 3138935 A1 3/2017
JP 2001107187 A 4/2001
(Continued)

OTHER PUBLICATIONS

Jul. 3, 2018, International Search Report issued in the International Patent Application No. PCT/JP2018/012697.
(Continued)

*Primary Examiner* — Colleen P Dunn
*Assistant Examiner* — Anthony M Liang
(74) *Attorney, Agent, or Firm* — Kenja IP Law PC

(57) ABSTRACT

Provided is a steel sheet having sufficient formability and strength even after sheet metal thinning, the steel sheet including: a chemical composition containing, by mass %, C: more than 0.0060% and not more than 0.012%, Si: 0.02% or less, Mn: 0.10% or more and 0.60% or less, P: 0.020% or less, S: 0.020% or less, Al: 0.01% or more and 0.07% or less, and N: 0.0080% or more and 0.0200% or less, with the balance being Fe and inevitable impurities, in which a dislocation density at a depth position of ½ of a sheet thickness from a surface of the steel sheet is $2.0\times10^{14}/m^2$ or more and $1.0\times10^{15}/m^2$ or less.

8 Claims, 5 Drawing Sheets

Schematic view of shape defect

(51) Int. Cl.

| | |
|---|---|
| ***C22C 38/04*** | (2006.01) |
| ***C21D 8/02*** | (2006.01) |
| ***B65D 41/12*** | (2006.01) |
| ***C22C 38/02*** | (2006.01) |

(52) U.S. Cl.
CPC ..... *C21D 8/0226* (2013.01); *C21D 8/0236* (2013.01); *C21D 8/0278* (2013.01); *C22C 38/02* (2013.01); *C22C 38/04* (2013.01); *C22C 38/06* (2013.01)

(56) References Cited

U.S. PATENT DOCUMENTS

| | | | |
|---|---|---|---|
| 2017/0051376 | A1 | 2/2017 | Tada et al. |
| 2017/0051377 | A1 | 2/2017 | Saito et al. |

FOREIGN PATENT DOCUMENTS

| | | | | |
|---|---|---|---|---|
| JP | 4559918 | B2 | 10/2010 | |
| JP | 2015151620 | A | 8/2015 | |
| JP | 6057023 | B2 | 1/2017 | |
| WO | 2013008457 | A1 | 1/2013 | |
| WO | 2015166646 | A1 | 11/2015 | |
| WO | 2015166653 | A1 | 11/2015 | |
| WO | 2016104773 | A1 | 6/2016 | |
| WO | WO-2016104773 | A1 * | 6/2016 | ..... C22C 38/00 |

OTHER PUBLICATIONS

Apr. 23, 2020, Office Action issued by the IP Australia in the corresponding Australian Patent Application No. 2018245470.
Dec. 6, 2019, the Extended European Search Report issued by the European Patent Office in the corresponding European Patent Application No. 18776541.7.
Sep. 4, 2020, Communication pursuant to Article 94(3) EPC issued by the European Patent Office in the corresponding European Patent Application No. 18776541.7.

* cited by examiner

Schematic view of shape defect

Crown cap viewed from top

Normal cross sectional shape profile

Cross sectional shape profile with shape defect

Schematic view of positional relationship before test

Schematic view of pushable distance of striking die

Appearance of steel sheet after test

Cross sectional profile of deformed portion

STEEL SHEET, METHOD OF MANUFACTURING SAME, CROWN CAP, AND DRAWING AND REDRAWING (DRD) CAN

BACKGROUND

This disclosure relates to a steel sheet, and in particular to a high-strength thin steel sheet with excellent formability and a method for manufacturing the same. Typical examples of such steel sheet include a thin steel sheet serving as a material of a crown cap used as a stopper for a glass bottle, as well as a DRD (Drawing and Redrawing) can formed by a combination of drawing and redrawing. This disclosure also relates to a crown cap and a DRD obtained by forming the steel sheet.

BACKGROUND

For example, metal caps called crown caps are often used in containers for beverages such as soft drinks and liquors. Generally, the crown cap is manufactured by press forming a thin steel sheet as a material, and comprises a disk-like portion for closing the mouth of the bottle and a corrugated portion provided around the periphery, and the corrugated portion is fixed by caulking onto the mouth of the bottle to seal the bottle.

Bottles that use a crown cap are often filled with contents that generate high internal pressure, such as beer or carbonated beverages. For this reason, even when the internal pressure is increased due to a change in temperature or the like, the crown cap needs to have high pressure resistance in order to prevent the crown cap from deforming and leaking the content. Furthermore, in the case where the internal pressure is increased due to a change in temperature or the like, impact resistance is also important such that the seal of the bottle is not broken by an external impact during transportation. In addition, even if the strength of the material is sufficient, if the formability is poor, the shape of the corrugated portion becomes uneven. Then, sufficient sealing performance may not be obtained when a crown cap of such a faulty shape is fixed by caulking onto the mouth of the bottle. Thus, it is also necessary that the steel sheet be excellent in formability.

SR (Single Reduced) steel sheets are mainly used as thin steel sheets to be used as materials for crown caps. SR steel sheets are manufactured by a process including thinning by cold rolling, annealing, and temper rolling. The thickness of conventional steel sheets for crown caps is generally 0.22 mm or more, and sufficient pressure resistance, impact resistance, and formability have been secured by applying SR material made of mild steel used for food and beverage cans and the like.

In recent years, as with steel sheets for cans, there has been an increasing demand for sheet metal thinning of steel sheets for crown caps for the purpose of cost reduction. If the thickness of the steel sheet for crown caps is less than 0.22 mm, particularly 0.20 mm or less, the pressure resistance and impact resistance of the crown cap manufactured using the conventional SR material are insufficient. In order to secure the pressure resistance and impact resistance, a DR (Double Reduced) steel sheet is applied, which can be subjected to secondary cold roling and hardened after annealing to compensate for the decrease in strength due to sheet metal thinning.

Crown caps are squeezed to some extent at the center at the beginning of forming, and then the outer edge is formed into a corrugated shape. Here, if the material of a crown cap is a steel sheet having low formability, a shape defect as schematically illustrated in FIG. 1 may occur, in which a fold forms from the crown cap upper surface side deviating from the proper position. Not only does such a crown cap with a shape defect look poor and reduce the consumer's purchase intention, but even when plugged in a bottle, it does not provide proper pressure resistance and impact resistance, and the contents may leak.

On the other hand, DRD cans need to have high pressure resistance such that the cans do not deform if the internal pressure increases or decreases. Furthermore, impact resistance is also important because deformation of a DRD can due to external impact during transportation may result in leakage of the contents and loss of consumer confidence due to the loss of the appearance. In addition, even when the strength of the steel sheet as the material of a DRD can is sufficient, if the steel sheet is poor in formability, this will lead to a shape defect in which wrinkles form in the flange during DRD can formation. When wrinkles form in the flange portion, when the pressure inside the can increases or decreases after the steel sheet is formed into a DRD can, stress tends to be concentrated in the vicinity of the wrinkle formation portion, and sufficient pressure resistance may not be obtained. Therefore, the steel sheet to be used as the material of a DRD can is also required to have excellent formability.

Moreover, in recent years, in the same manner as the crown cap steel sheet, the demand for sheet metal thinning of the steel sheet for DRD cans has also been increased for the purpose of cost reduction. With this sheet metal thinning, it has become more important to secure sufficient pressure resistance and impact resistance and formability.

In view of the above, for a high strength thin steel sheet for crown caps, for example, JP6057023B (PTL 1) proposes a steel sheet for crown caps comprising a chemical composition containing, by mass %, C: 0.0010% to 0.0060%, Si: 0.005% to 0.050%, Mn: 0.10% to 0.50% Ti: 0% to 0.100%, Nb: 0% to 0.080%, B: 0% to 0.0080%, P: 0.040% or less, S: 0.040% or less, Al: 0.1000% or less, and N: 0.0100% or less, with the balance being Fe and impurities, wherein a minimum value of r values in a direction of 25° to 65° with respect to a rolling direction of the steel sheet is 1.80 or more, and an average value of r values in a direction of 0° or more and less than 360° with respect to the rolling direction is 1.70 or more, and wherein a yield strength is 570 MPa or more.

In addition, for example, JP4559918B (PTL 2) describes a steel sheet for tin plates and TFS having excellent formability, comprising a chemical composition containing, by mass %, C: 0.0030% to 0.0060%, Si: 0.04% or less, Mn: 0.60% or less, P: 0.005% or more and 0.03% or less, S: 0.02% or less, Al: more than 0.005%, 0.1% or less, and N: 0.005% or less within a range satisfying a a predetermined formula, with the balance being Fe and inevitable impurities, wherein a sheet thickness is 0.2 mm or less, a hardness level (HR30T) is 67±3 to 76±3, and an Δr value indicating in-plane anisotropy is ±0.2 or less.

CITATION LIST

Patent Literature

PTL 1: JP6057023B

SUMMARY

Technical Problem

A steel sheet manufactured by the technique described in PTL 1 tends to be insufficient in formability and strength particularly after sheet metal thinning, and a crown cap formed using the steel sheet as a material has the problem of having a lower impact resistance than that of a conventional crown cap. This problem is the same as in the case of a material for DRD cans.

The steel sheet manufactured by the technique described in PTL 2 tends to be insufficient in formability and strength particularly after sheet metal thinning, and a DRD can formed using the steel sheet as a material has the problem of having a lower impact resistance than that of a conventional DRD can. This problem is the same as in the case of a crown cap material.

It would thus be helpful to provide a steel sheet with sufficient formability and strength even after sheet metal thinning, and a method of manufacturing the same.

Solution to Problem

The inventors made intensive studies on how to solve the above problems, and found that by optimizing the alloy components and manufacturing conditions and controlling the dislocation density at a depth position of ½ of a sheet thickness from a surface, it is possible to provide a steel sheet having sufficient formability and strength. The present disclosure was completed based on this finding, and the summary thereof is as follows.

(1) A steel sheet comprising: a chemical composition containing (consisting of), by mass %, C: more than 0.006% and not more than 0.012%, Si: 0.02% or less, Mn: 0.10% or more and 0.60% or less, P: 0.020% or less, S: 0.020% or less, Al: 0.01% or more and 0.07% or less, and N: 0.0080% or more and 0.0200% or less, with the balance being Fe and inevitable impurities, wherein a dislocation density at a depth position of ½ of a sheet thickness from a surface of the steel sheet is $2.0\times10^{14}/m^2$ or more and $1.0\times10^{15}/m^2$ or less.

(2) The steel sheet according to (1), having a thickness of 0.20 mm or less.

(3) A crown cap made of the steel sheet as recited in (1) or (2).

(4) A DRD can made of the steel sheet as recited in (1) or (2).

(5) A method of manufacturing the steel sheet as recited in (1) or (2), comprising: a hot rolling step of heating a steel raw material at 1200° C. or higher, finish rolling the steel raw material to obtain a hot rolled sheet, and coiling the hot rolled sheet within a temperature range of 670° C. or lower; a pickling step of pickling the hot rolled sheet after the hot rolling step; a primary cold rolling step of cold rolling the hot rolled sheet after the pickling step to obtain a cold rolled sheet; an annealing step of annealing the cold rolled sheet after the primary cold rolling step in a temperature range of 650° C. to 750° C. to obtain an annealed sheet; and a secondary cold rolling step of cold rolling the annealed sheet after the annealing step, with a rolling reduction of 10% or more and 30% or less and an average tension of 98 MPa or more between cold rolling stands in a rolling apparatus having at least two cold rolling stands.

Advantageous Effect

According to the present disclosure, it is possible to provide a steel sheet having sufficient strength and excellent formability even after sheet metal thinning. In particular, when a crown cap or a DRD can is manufactured using this steel sheet as a material, the impact resistance performance can be maintained at a high level in a crown cap or a DRD can even after sheet metal thinning.

DETAILED DESCRIPTION

Figure 1:
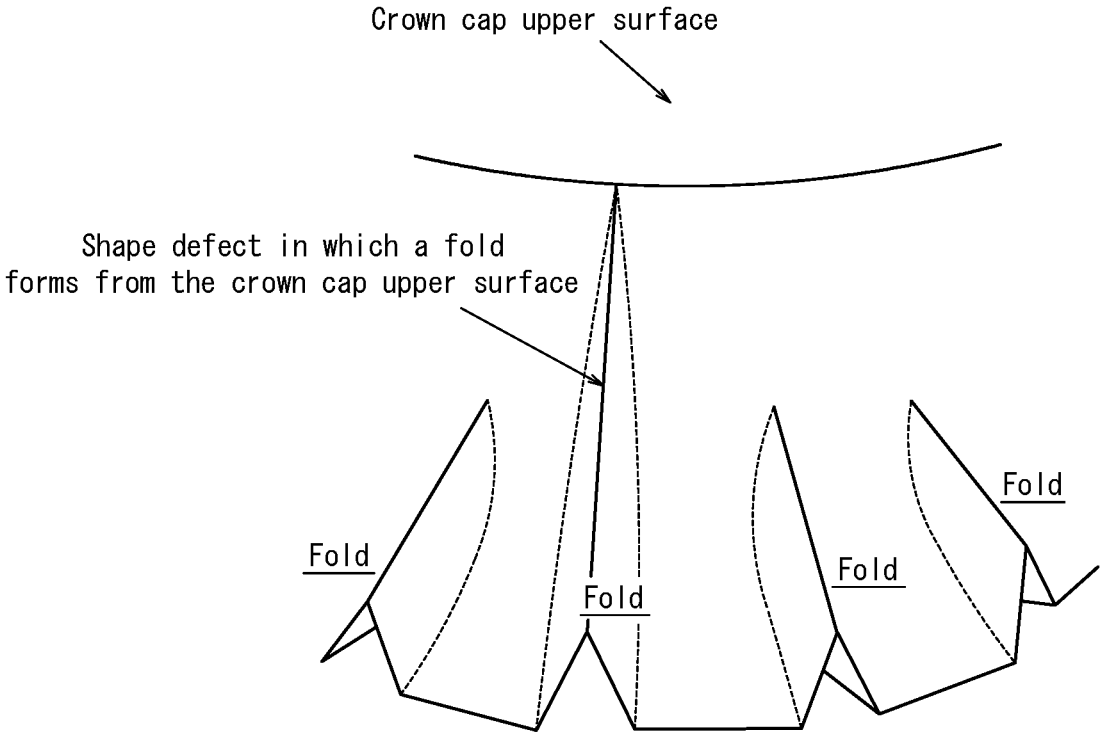
FIG. 1 is a schematic view illustrating a crown cap having a poor shape.
Figure 2:
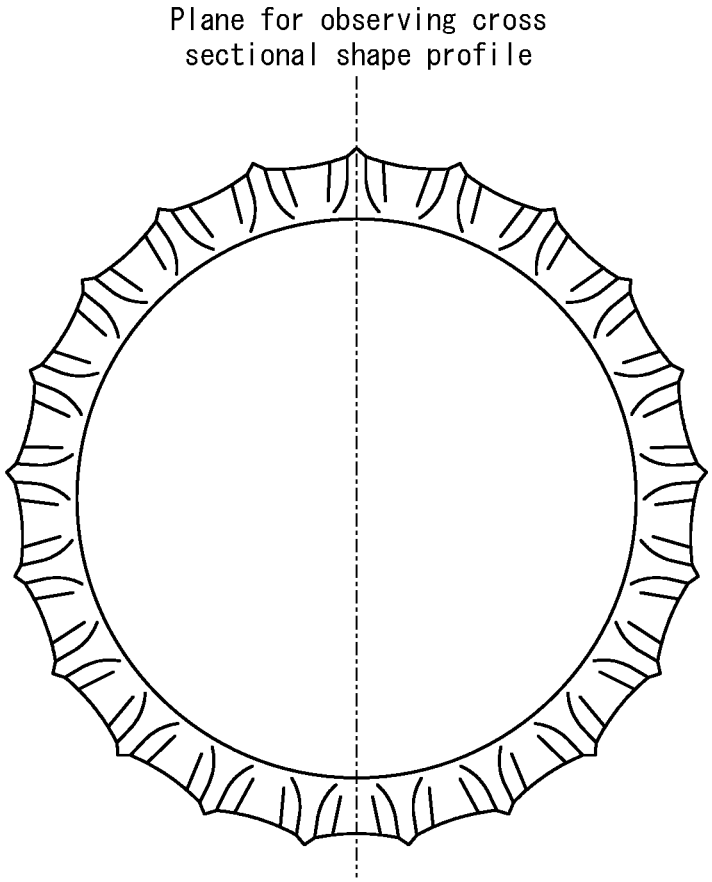
FIG. 2 illustrates a surface of a crown cap for observing a cross-sectional shape profile.

The steel sheet according to the present disclosure comprises: a chemical composition containing, by mass %, C: more than 0.006% and not more than 0.012%, Si: 0.02% or less, Mn: 0.10% or more and 0.60% or less, P: 0.020% or less, S: 0.020% or less, Al: 0.01% or more to 0.07% or less, and N: 0.0080% or more and 0.0200% or less, with the balance being Fe and inevitable impurities, wherein a dislocation density at a depth position of ½ of a sheet thickness from a surface of the steel sheet is $2.0\times10^{14}/m^2$ or more and $1.0\times10^{15}/m^2$ or less.

First, the reasons for limitation of the content of each component in the chemical composition of the steel sheet will be described in order. In the following description, "%" notation represents "mass %" unless otherwise specified.

C: more than 0.006% and 0.012% or Less

C is an interstitial element, and a large amount of solid solution strengthening can be obtained with a small amount of addition. As a result of improving the frictional force of the base steel sheet by this solid solution strengthening, the moving speed of dislocations during secondary cold rolling described later decreases, and a large amount of dislocations are introduced into the material even with a low rolling reduction, and the dislocation density improves. That is, when the C content is 0.006% or less, the dislocation density at a depth of ½ of the sheet thickness from the surface of the steel sheet is less than $2.0\times10^{14}/m^2$, and for example, when the steel sheet is used for a crown cap, the same impact resistance as that of a conventional crown cap can not be obtained. Similarly, when the steel sheet is used as a DRD can, for example, to form a thin DRD can, the same impact resistance as that of a conventional DRD can may not be obtained. On the other hand, when the C content exceeds 0.012%, the dislocation density at a depth of ½ of the sheet thickness from the surface of the steel sheet exceeds $1.0\times10^{15}/m^2$, and the formability of the steel sheet is lowered. For example, when the steel sheet is used for a crown cap, a shape defect occurs in which a fold forms from the crown cap upper surface during crown cap formation. Similarly, when the steel sheet is used for a DRD can, for example, a shape defect occurs in which wrinkles form in the flange portion during DRD can formation. From the above, the C content is more than 0.006% and 0.012% or less. Preferably, it is 0.007% or more and 0.01% or less.

Si: 0.02% or Less

When the content of Si exceeds 0.02%, the formability of the steel sheet is reduced, and for example, a shape defect occurs in which a fold forms from the crown cap upper surface during crown cap formation. Similarly, when the steel sheet is used for a DRD can, for example, a shape defect occurs in which wrinkles form in the flange portion during DRD can formation. Furthermore, the surface treatment property of the steel sheet is deteriorated and the corrosion resistance is lowered. From the above, the Si content is 0.02% or less. Preferably, it is 0.01% or less. Note that it is preferable to set the Si content to 0.004% or more, since reducing Si excessively causes increase of steelmaking cost.

Mn: 0.10% to 0.60%

Mn is a interstitial element, and a large amount of solid solution strengthening can be obtained with a small amount of addition. As a result of improving the frictional force of the base steel sheet by this solid solution strengthening, the moving speed of dislocations during secondary cold rolling described later decreases, and a large amount of dislocations are introduced into the material even with a low rolling reduction, and the dislocation density improves. That is, when the Mn content is less than 0.10%, the dislocation density at a depth position of ½ of the sheet thickness from the surface of the steel sheet is less than $2.0\times10^{14}/m^2$, and for example, when the steel sheet is used for a crown cap and after sheet metal thinning, the same impact resistance as a conventional crown cap can not be obtained. Similarly, when the steel sheet is used as a DRD can, for example, and after sheet metal thinning, the same impact resistance as that of a conventional DRD can may not be obtained. Furthermore, if the Mn content is less than 0.10%, it becomes difficult to avoid hot brittleness even if the S content is reduced, and problems such as surface cracking occur during continuous casting. On the other hand, when the Mn content exceeds 0.60%, the formability of the steel sheet is reduced, and for example, when the steel sheet is used for a crown cap, a shape defect occurs in which a fold forms from the crown cap upper surface during crown cap formation. Similarly, when the steel sheet is used for a DRD can, for example, a shape defect in which wrinkles form in the flange portion during DRD can formation. From the above, the Mn content is 0.10% or more and 0.60% or less. Preferably, the Mn content is 0.15% or more and 0.50% or less.

P: 0.020% or Less

When the P content exceeds 0.020%, the formability of the steel sheet is reduced, and for example, when the steel sheet is used for a crown cap, a shape defect occurs in which a fold forms from the crown cap upper surface during crown cap formation. Similarly, when the steel sheet is used for a DRD can, for example, a shape defect occurs in which wrinkles form in the flange portion during DRD can formation. Furthermore, the corrosion resistance is reduced. From the above, the P content is 0.020% or less. Preferably, it is 0.015% or less. Note that reducing the P content below 0.001% requires excessive dephosphorization cost, the P content is preferably 0.001% or more.

S: 0.020% or Less

When the S content exceeds 0.020%, inclusions are formed in the steel sheet to cause a decrease in hot ductility and a deterioration in corrosion resistance of the steel sheet, and further, a formability of the steel sheet is reduced. When the steel sheet is used for a crown cap, a shape defect occurs in which a fold forms from the crown cap upper surface during crown cap formation. Similarly, when the steel sheet is used for a DRD can, for example, a shape defect occurs in which wrinkles form in the flange portion during DRD formation. Therefore, the S content is 0.020% or less. Preferably, it is 0.015% or less. In addition, reducing the S content below 0.005% requires excessive desulfurization cost, the S content is preferably 0.004% or more.

Al: 0.01% or More and 0.07% or Less

Al is an element necessary as a deoxidizer at the time of steel making, yet if the Al content is less than 0.01%, deoxidation becomes insufficient, inclusions increase, and the formability of the steel sheet decreases, and for example, when the steel sheet is used for a crown cap, a shape defect occurs in which a fold forms from the crown cap upper surface during crown cap formation. Similarly, when the steel sheet is used for a DRD can, for example, a shape defect occurs in which wrinkles form in the flange portion during DRD can formation. On the other hand, when the Al exceeds 0.07%, a large amount of MN is formed, and thus the amount of N in the steel decreases and the effect of N described later can not be obtained. From the above, the Al content is 0.01% or more and 0.07% or less. Preferably, it is 0.15% or more and 0.55% or less.

N: 0.0080% or More to 0.0200% or Less

N is an interstitial element and, like C, a large amount of solid solution strengthening can be obtained with a small amount of addition. As a result of improving the frictional force of the base steel sheet by this solid solution strengthening, the moving speed of dislocations during secondary cold rolling described later decreases, and a large amount of dislocations are introduced into the material even with a low rolling reduction, and the dislocation density improves. That is, when the N content is less than 0.0080%, the dislocation density at a depth position of ½ of the sheet thickness from the surface of the steel sheet is less than $2.0\times10^{14}/m^2$, and for example, when the steel sheet is used for a crown cap and after sheet metal thinning, the same impact resistance as that of a conventional thick crown cap can not be obtained. Similarly, for example, when the steel sheet is used for a DRD can and after sheet metal thinning, the same impact resistance as that of a conventional DRD can may not be obtained. On the other hand, when the N content exceeds 0.0200%, the dislocation density at a depth position of ½ of the sheet thickness from the surface of the steel sheet exceeds $1.0\times10^{15}/m^2$, the formability of the steel sheet decreases, and for example, when the steel sheet is used for a crown cap, a shape defect occurs in which a fold forms from the crown cap upper surface during crown cap formation. Similarly, when the steel sheet is used for a DRD can, for example, a shape defect occurs in which wrinkles form in the flange portion during DRD can formation. From the above, the N content is 0.0080% or more and 0.0200% or less. Preferably, it is 0.0090% or more and 0.019% or less. The balance other than the above components is Fe and inevitable impurities.

Furthermore, Cu, Ni, Cr, and Mo may be contained in the range which does not impair the effect of the present disclosure. At that time, according to ASTM A623M-11, it is preferable that Cu is 0.2% or less, Ni is 0.15% or less, Cr is 0.10% or less, and Mo is 0.05% or less. The contents of the other elements are preferably 0.02% or less.

Further, in the steel sheet disclosed herein, it is important that the dislocation density at a depth position of ½ of the sheet thickness from the surface of the steel sheet is $2.0\times10^{14}/m^2$ or more and $1.0\times10^{15}/m^2$ or less. Our intensive studies revealed that the strength of the steel sheet can be evaluated by, for example, the impact resistance of a crown cap when the steel sheet is used for a crown cap, or the impact resistance of a DRD can when the steel sheet is used for a DRD can, and that these impact resistances can be improved by the increase of dislocation density. When the dislocation density at a depth position of ½ of the sheet thickness from the surface of the steel sheet is $2.0\times10^{14}/m^2$ or more, it is possible to obtain a impact resistance equivalent to that of a conventional thick crown cap or DRD can, even after sheet metal thinning. Although the reason for this is not clear, it is believed that as dislocation density increases, deformation resistance increases due to pinning of dislocations. Therefore, even when an external impact is applied to a crown cap, for example, in a state where the internal pressure of the bottle is high, the crown cap is less likely to come off. Alternatively, for example, when an external impact is applied to a DRD can, the can becomes difficult to deform. Therefore, the dislocation density at a depth position of ½ of the sheet thickness from the surface of the steel sheet is set to $2.0\times10^{14}/m^2$ or more.

On the other hand, when the dislocation density at a depth position of ½ of the sheet thickness from the surface of the steel sheet exceeds $1.0\times10^{15}/m^2$, the formability of the steel sheet is reduced, and for example, when the steel sheet is used for a crown cap, a shape defect occurs in which a fold forms from the crown cap upper surface during crown cap formation. Similarly, when the steel sheet is used for a DRD can, for example, a shape defect occurs in which wrinkles form in the flange portion during DRD can formation. From the above, the dislocation density at a depth position of ½ of the sheet thickness from the surface of the steel sheet is set to $2.0\times10^{14}/m^2$ or more and $1.0\times10^{15}/m^2$ or less. A more preferable range is $3.0\times10^{14}/m^2$ or more and $9.0\times10^{14}/m^2$ or less. In order to set the dislocation density in the above range, the steel slab with the above-described chemical composition may be subjected to the manufacturing process described later.

In this case, the dislocation density at a depth position of ½ of the thickness from the surface of the steel sheet was determined by performing X-ray diffraction using a Co radiation source on a surface exposed by chemical polishing the surface of the steel sheet to the depth position of ½ of the sheet thickness to measure peak positions and half-value widths of 4 planes of Fe(110), (200), (211), and (220). Each of the measured half-value widths was corrected with a half-value width of an unstrained Si single crystal, a local strain c was determined by the Williamson Hall method, and the dislocation density p was calculated using the following Equation (1):

$$\rho = \frac{14.4\times\varepsilon^2}{b^2}, \tag{1}$$

where Burgers vector b was 0.25 nm.

The structure of the steel sheet disclosed herein is preferably a recrystallized structure. The reason is that if there is non-recrystallization after annealing, the material uniformity decreases, and for example, a fold forms from the crown cap upper surface during crown cap formation. Alternatively, for example, a shape defect occurs in which wrinkles form in the flange portion during DRD can formation. However, if the area ratio of non-recrystallized microstructures is 5% or less, it does not substantially affect the shape defect in which a fold forms from the crown cap upper surface during crown cap formation, nor the shape defect in which wrinkles form in the flange portion during DRD can formation. Therefore, an area ratio of non-recrystallized microstructures of 5% or less is acceptable. The recrystallized microstructure is preferably a ferrite phase, and the phases other than the ferrite phase are preferably less than 1.0%.

Next, the manufacturing method disclosed herein will be described. The manufacturing method includes a hot rolling step, a pickling step, a primary cold rolling step, an annealing step, and a secondary cold rolling step. In the following description, the temperature is defined as the surface temperature of a steel sheet (blank sheet).

First, a steel adjusted to the above-described chemical composition is melted in a converter or the like to obtain a steel raw material such as a slab. The steel material used is preferably manufactured by continuous casting to prevent macrosegregation of the components, yet may be manufactured by ingot casting or thin slab casting. In addition, after manufactured, the steel raw material may be cooled to room temperature and heated again according to a conventional method, or alternatively to a heat energy saving process such as direct feed rolling and direct rolling in which the steel sheet is charged into the furnace as a hot piece without being cooled to room temperature, or is alternatively subjected to slight soaking, immediately followed by rolling, without problems. The obtained steel material is subjected to hot rolling. This hot rolling step is a step of heating a steel material having the above-mentioned chemical composition at 1200° C. or higher, finish rolling the steel raw material to obtain a hot rolled sheet, and coiling the hot rolled sheet within a temperature range of 670° C. or lower.

[Steel Raw Material Heating Temperature: 1200° C. or Higher]

When reheating the steel material, if the steel material reheating temperature is lower than 1200° C., MN can not be sufficiently dissolved, and formation of solute N can not be secured at the time of the secondary cold rolling step. Thus, the dislocation density improving effect can not be obtained, and the dislocation density becomes less than $2.0\times10^{14}/m^2$ at a depth position of ½ of the sheet thickness from the surface of the steel sheet, and for example, when the steel sheet is used as a crown cap and after sheet metal thinning, an impact resistance equivalent to that of a conventional thick crown cap can not be obtained. Alternatively, for example, when the steel sheet is used as a DRD can and after sheet metal thinning, an impact resistance equivalent to that of a conventional DRD can may not be obtained. It is desirable that the slab heating temperature be 1300° C. or lower in view of the increase in scale loss due to the increase in the oxidation weight. Note that it is also possible to use what is called a sheet bar heater which heats a sheet bar from the viewpoint of preventing hot rolling problems even if the slab heating temperature is lowered.

[Finish Rolling]

The finish rolling temperature in the hot rolling step is preferably 850° C. or higher from the viewpoint of the stability of the rolling load. On the other hand, raising the finish rolling temperature more than necessary may make it difficult to manufacture thin steel sheets. Specifically, the finish rolling temperature is preferably in a temperature range of 850° C. to 960° C.

[Coiling Temperature: 670° C. or Lower]

If the coiling temperature exceeds 670° C., the amount of MN precipitated in the steel after coiling increases, solute N can not be sufficiently secured during the secondary cold rolling step, and thus the dislocation density improving effect can not be obtained. The dislocation density at a depth position of ½ of the sheet thickness from the surface in the sheet thickness direction is less than $2.0\times10^{14}/m^2$. Therefore, the coiling temperature is 670° C. or lower. Preferably, the temperature is 640° C. or lower. On the other hand, the lower limit of the coiling temperature is not particularly limited, yet if the coiling temperature is excessively lowered, the strength of the hot rolled steel sheet obtained in the hot rolling step increases, the rolling load in the primary cold rolling step increases, and it is difficult to control rolling. Therefore, the coiling temperature is preferably 500° C. or higher.

In the hot rolling disclosed herein, in order to reduce the rolling load at the time of hot rolling, part or all of finish rolling may be lubricated rolling. Lubricated rolling is also effective from the viewpoint of making the shape of the steel sheet uniform and making the material uniform. The coefficient of friction in lubrication rolling is preferably in a range of 0.25 to 0.10. Moreover, it is preferable to set it as a continuous rolling process which joins preceding and following sheet bars, and carries out finish rolling continuously. Applying a continuous rolling process is also desirable from the viewpoint of the hot rolling operation stability.

[Pickling Process]

Then, pickling is performed. The pickling step is a step of removing oxide scales on the surface of the hot rolled steel sheet obtained in the hot rolling step by pickling. The pickling conditions are not particularly limited, and may be set as appropriate.

[Primary Cold Rolling Process]

After the pickling, primary cold rolling is performed. The primary cold rolling step is a step of subjecting the pickled sheet after the pickling step to cold rolling. The cold rolling conditions are not particularly limited, and for example, the conditions such as the rolling reduction may be determined from the viewpoint of the desired sheet thickness and the like. In order to make the thickness of the steel sheet after secondary cold rolling be 0.20 mm or less, the rolling reduction is preferably 85% to 94%.

[Annealing Process]

Next, annealing is performed on the primary cold rolled sheet. The annealing step is a step of annealing the cold rolled steel sheet obtained in the primary cold rolling step in a temperature range of 650° C. to 750° C. If the annealing temperature is lower than 650° C., MN precipitates during annealing, and solute N can not be secured during the subsequent secondary cold rolling process. Thus, the dislocation density improving effect can not be obtained, and the dislocation density at a depth position of ½ of the sheet thickness from the surface of the steel sheet is less than $2.0\times10^{14}/m^2$. Furthermore, if the annealing temperature is lower than 650° C., the area ratio of the non-recrystallized microstructures exceeds 5%, and the formability deteriorates.

On the other hand, if the annealing temperature exceeds 750° C., C segregates at the grain boundaries and aggregates to form carbides, and thus sufficient solute C can not be secured during the secondary cold rolling step. Accordingly, the dislocation density improving effect can not be obtained, and the dislocation density at a depth position of ½ of the sheet thickness from the surface in the sheet thickness direction is less than $2.0\times10^{14}/m^2$. From the above, the annealing temperature is 650° C. or higher and 750° C. or lower. Preferably, it is 660° C. or higher and 740° C. or lower. The holding time in the temperature range of 650° C. to 750° C. is not particularly limited, yet if the holding time is shorter than 5 seconds, non-recrystallized microstructures may exceed 5%, and if it exceeds 120 seconds, C segregates at grain boundaries and aggregates to form carbides, solute C may not be sufficiently secured in the secondary cold rolling step, and the cost is increased. Therefore, the holding time is preferably 5 seconds or more and 120 seconds or less.

[Secondary Cold Rolling Process]

Secondary cold rolling is performed on the annealed sheet after the annealing. The secondary cold rolling step is a step of cold rolling the annealed sheet obtained in the annealing step, with a rolling reduction of 10% or more to 30% or less and an average tension of 98 MPa or more between cold rolling stands in a rolling apparatus having at least two cold rolling stands. When the average tension between the cold rolling stands is less than 98 MPa, the dislocation density at a depth position of ½ of the sheet thickness from the surface of the steel sheet is less than $2.0\times10^{14}/m^2$. The average tension between the cold rolling stands is preferably 127.4 MPa or more. On the other hand, the upper limit of the average tension between the cold rolling stands is not particularly limited, and may be determined from the viewpoint of operability. For example, the tension may be adjusted so as not to cause fracture of the steel sheet. Specifically, 392 MPa or less is preferable. When the rolling reduction of secondary cold rolling is less than 10%, the dislocation density at a depth position of ½ of the sheet thickness from the surface of the steel sheet is less than $2.0\times10^{14}/m^2$. On the other hand, when the rolling reduction of secondary cold rolling exceeds 30%, the dislocation density at a depth position of ½ of the sheet thickness from the surface of the steel sheet exceeds $1.0\times10^{15}/m^2$, and the formability of the steel sheet decreases. In view of the above, the rolling reduction of secondary cold rolling is 10% or more and 30% or less. The rolling reduction of secondary cold rolling is preferably 12% or more and 28% or less.

It suffices for the number of rolling stands for secondary cold rolling be plural. However, if it is five or more, the apparatus cost is increased. Therefore, two to four cold rolling stands are preferred.

Optionally, the cold rolled steel sheet thus obtained may then be subjected to plating treatment using electroplating, such as tin plating, chromium plating, or nickel plating, to form a plating layer on the surface of the steel sheet, and may be used as a plating steel sheet. In addition, since the thickness of the layer subjected to surface treatment such as plating is sufficiently smaller than the sheet thickness, the influence on the mechanical properties of the steel sheet is negligible.

As described above, the steel sheet disclosed herein may have sufficient formability and strength even after subjected to sheet metal thinning. Therefore, the steel sheet disclosed herein is particularly suitable as a material for a crown cap or a DRD can.

The crown cap is mainly composed of a disk-like portion for closing the mouth of the bottle and a corrugated portion provided around the periphery, and can be formed by punching the steel sheet disclosed herein into a circular blank and press forming the circular blank. A crown cap made of the steel sheet disclosed herein has an excellent forming shape as a crown cap and excellent impact resistance, and has an effect of reducing the amount of waste discharged with use.

In addition, the DRD can may be formed by punching the above-described steel sheet into a circular blank and then drawing and redrawing the circular blank. The DRD can made of the steel sheet disclosed herein is excellent in impact resistance, uniform in shape, and does not deviate from the product specification. Therefore, the yield in the DRD can manufacturing process is improved, and the effect of reducing the amount of waste discharged from DRD can manufacturing is also achieved.

EXAMPLES

Steel Slabs having the chemical compositions listed in Table 1 with the balance being Fe and inevitable impurities were prepared by steelmaking in a converter and subjected to continuous casting to obtain steel slabs. The steel slabs thus obtained were heated to 1220° C., subjected to finish rolling at 890° C. to obtain hot rolled sheet, and coiled at coiling temperatures listed in Table 2. After the hot rolling, pickling was performed. Then, primary cold rolling was performed with a rolling reduction of 90%, annealing was performed under the annealing temperatures listed in Table 2, and secondary cold rolling was subsequently performed with the rolling reductions listed in Table 2 to obtain steel sheets having a sheet thickness of 0.17 mm. Each of the obtained steel sheets was continuously subjected to electrolytic chromic acid treatment to obtain a tin-free steel.

TABLE 1

(mass %)

| Steel | C | Si | Mn | P | S | sol. Al | N | |
|---|---|---|---|---|---|---|---|---|
| A | 0.0064 | 0.01 | 0.31 | 0.006 | 0.005 | 0.032 | 0.0130 | Example |
| B | 0.0075 | 0.01 | 0.46 | 0.002 | 0.004 | 0.056 | 0.0152 | Example |
| C | 0.0092 | 0.02 | 0.22 | 0.012 | 0.001 | 0.021 | 0.0112 | Example |
| D | 0.0111 | 0.01 | 0.21 | 0.018 | 0.006 | 0.035 | 0.0094 | Example |
| E | 0.0081 | 0.01 | 0.16 | 0.005 | 0.011 | 0.033 | 0.0193 | Example |
| F | 0.0078 | 0.01 | 0.32 | 0.010 | 0.008 | 0.015 | 0.0085 | Example |
| G | 0.0036 | 0.02 | 0.18 | 0.008 | 0.006 | 0.045 | 0.0143 | Comparative example |
| H | 0.0142 | 0.01 | 0.55 | 0.007 | 0.007 | 0.051 | 0.0124 | Comparative example |
| I | 0.0088 | 0.02 | 0.22 | 0.012 | 0.013 | 0.036 | 0.0074 | Comparative example |
| J | 0.0081 | 0.01 | 0.19 | 0.003 | 0.009 | 0.020 | 0.0215 | Comparative example |
| K | 0.0072 | 0.03 | 0.21 | 0.009 | 0.008 | 0.041 | 0.0132 | Comparative example |
| L | 0.0095 | 0.01 | 0.62 | 0.003 | 0.009 | 0.020 | 0.0132 | Comparative example |
| M | 0.0096 | 0.01 | 0.35 | 0.022 | 0.007 | 0.025 | 0.0122 | Comparative example |
| N | 0.0101 | 0.01 | 0.15 | 0.011 | 0.008 | 0.072 | 0.0163 | Comparative example |
| O | 0.0075 | 0.01 | 0.20 | 0.009 | 0.006 | 0.004 | 0.0142 | Comparative example |
| P | 0.0060 | 0.01 | 0.25 | 0.009 | 0.006 | 0.044 | 0.0125 | Comparative example |
| Q | 0.0079 | 0.01 | 0.21 | 0.010 | 0.007 | 0.069 | 0.0119 | Example |
| R | 0.0078 | 0.01 | 0.08 | 0.008 | 0.005 | 0.059 | 0.0111 | Comparative example |
| S | 0.0094 | 0.02 | 0.35 | 0.013 | 0.021 | 0.049 | 0.0099 | Comparative example |

*Underlined if outside of the scope of the disclosure.

TABLE 2

| | | Hot rolling step | | Annealing step | | Secondary cold rolling step | | | |
|---|---|---|---|---|---|---|---|---|---|
| No. | Steel | Slab heating temp. (° C.) | Coiling temp. (° C.) | Annealing temp. (° C.) | Holding time in temp. range of 650° C. to 750° C. (s) | Number of stands | Average tensile strength between stands (MPa) | Rolling reduction (%) | Remarks |
| 1 | A | 1250 | 640 | 670 | 20 | 2 | 205.8 | 15 | Example |
| 2 | A | 1230 | 600 | 700 | 30 | 3 | 245.0 | 25 | Example |
| 3 | A | 1180 | 600 | 720 | 40 | 2 | 147.0 | 20 | Comparative example |
| 4 | B | 1280 | 600 | 730 | 50 | 3 | 225.4 | 25 | Example |
| 5 | B | 1200 | 600 | 690 | 30 | 2 | 196.0 | 25 | Example |
| 6 | B | 1250 | 650 | 730 | 70 | 2 | 156.8 | 25 | Example |
| 7 | B | 1230 | 600 | 730 | 60 | 2 | 313.6 | 40 | Comparative example |
| 8 | B | 1230 | 700 | 730 | 90 | 2 | 137.2 | 25 | Comparative example |
| 9 | C | 1250 | 600 | 660 | 100 | 3 | 117.6 | 15 | Example |
| 10 | C | 1250 | 600 | 680 | 10 | 2 | 186.2 | 25 | Example |
| 11 | C | 1220 | 640 | 700 | 25 | 2 | 147.0 | 25 | Example |
| 12 | C | 1250 | 600 | 700 | 40 | 2 | 78.4 | 15 | Comparative example |
| 13 | C | 1250 | 600 | 600 | 20 | 3 | 254.8 | 25 | Comparative example |
| 14 | D | 1250 | 550 | 680 | 60 | 3 | 254.8 | 25 | Example |
| 15 | D | 1210 | 640 | 700 | 60 | 4 | 303.8 | 20 | Example |
| 16 | D | 1210 | 640 | 700 | 130 | 4 | 303.8 | 20 | Example |
| 17 | D | 1270 | 550 | 780 | 70 | 2 | 254.8 | 25 | Comparative example |
| 18 | E | 1220 | 620 | 700 | 30 | 3 | 196.0 | 20 | Example |
| 19 | E | 1220 | 640 | 700 | 50 | 2 | 215.6 | 20 | Example |
| 20 | E | 1220 | 630 | 700 | 60 | 3 | 284.2 | 5 | Comparative example |
| 21 | F | 1240 | 660 | 730 | 40 | 3 | 294.0 | 25 | Example |
| 22 | F | 1240 | 640 | 730 | 40 | 2 | 333.2 | 20 | Example |
| 23 | F | 1240 | 620 | 730 | 40 | 2 | 205.8 | 15 | Example |
| 24 | G | 1250 | 600 | 700 | 30 | 2 | 225.4 | 20 | Comparative example |
| 25 | H | 1250 | 600 | 700 | 30 | 2 | 225.4 | 20 | Comparative example |
| 26 | I | 1250 | 600 | 700 | 30 | 2 | 225.4 | 20 | Comparative example |
| 27 | J | 1250 | 600 | 700 | 30 | 2 | 225.4 | 20 | Comparative example |
| 28 | K | 1250 | 600 | 700 | 30 | 2 | 225.4 | 20 | Comparative example |
| 29 | L | 1250 | 600 | 700 | 30 | 2 | 225.4 | 20 | Comparative example |
| 30 | M | 1250 | 600 | 700 | 30 | 2 | 225.4 | 20 | Comparative example |

TABLE 2-continued

| | | Hot rolling step | | Annealing step | | Secondary cold rolling step | | | |
|---|---|---|---|---|---|---|---|---|---|
| No. | Steel | Slab heating temp. (° C.) | Coiling temp. (° C.) | Annealing temp. (° C.) | Holding time in temp. range of 650° C. to 750° C. (s) | Number of stands | Average tensile strength between stands (MPa) | Rolling reduction (%) | Remarks |
| 31 | N | 1250 | 600 | 700 | 30 | 2 | 225.4 | 20 | Comparative example |
| 32 | O | 1250 | 600 | 700 | 30 | 2 | 225.4 | 20 | Comparative example |
| 33 | P | 1250 | 600 | 700 | 30 | 2 | 225.4 | 20 | Comparative example |
| 34 | Q | 1210 | 580 | 740 | 25 | 2 | 245.0 | 15 | Example |
| 35 | R | 1210 | 580 | 740 | 25 | 2 | 245.0 | 15 | Comparative example |
| 36 | S | 1210 | 580 | 740 | 25 | 2 | 245.0 | 15 | Comparative example |

*Underlined if outside of the scope of the disclosure.

For each of the steel sheets thus obtained, the dislocation density at a depth position of ½ of the thickness from the surface of the steel sheet was determined by performing X-ray diffraction using a Co radiation source on a surface exposed by chemical polishing the surface of the steel sheet to the depth position of ½ of the sheet thickness to measure peak positions and half-value widths of 4 planes of Fe(110), (200), (211), and (220). Each of the measured half-value widths was corrected with a half-value width of an unstrained Si single crystal, a local strain c was determined by the Williamson Hall method, and the dislocation density p was calculated using the following Equation (1):

$$\rho = \frac{14.4 \times \varepsilon^2}{b^2}, \quad (1)$$

where Burgers vector b was 0.25 nm.

Each of the steel sheets thus obtained was subjected to heat treatment corresponding to coating and baking at 210° C. for 15 minutes, and then formed into a crown cap, and crown cap formability was evaluated. A circular blank with a diameter of 37 mm was used and formed into the dimensions of three types of crown caps prescribed in "JIS S9017" (1957) (outer diameter: 32.1 mm, height: 6.5 mm, number of folds; 21) by press forming.

Figure 3A:
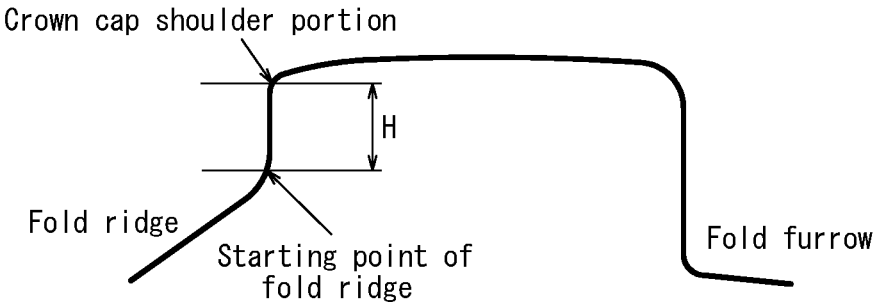
FIGS. 3A and 3B illustrate a typical example of a cross-sectional profile of a crown cap.
Figure 3B:
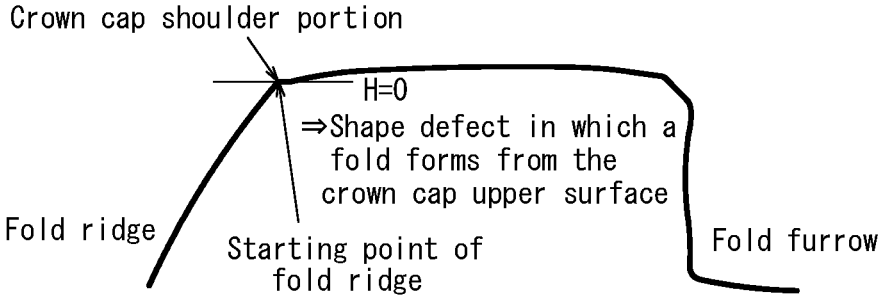

Each of the crown caps thus obtained was evaluated for formability by measuring the 3D shape from the top using a 3D shape measuring machine VR-3000 manufactured by Keyence. The evaluation of the formability of each crown cap was based on the presence or absence of a shape defect in which a fold formed from the crown cap upper surface. The cross sectional shape profile was observed in a cross sectional shape profile observation plane as typically illustrated in FIGS. 3A and 3B. Specifically, as illustrated in FIGS. 3A and 3B as a typical example of a cross sectional shape profile, it is assumed that the starting point of a fold ridge is located at the inflection point of the portion where the fold ridge starts, and the vertical distance H between the inflection point of a shoulder portion of the crown cap and at the starting point of the fold ridge. As illustrated in FIG. 3A, if the vertical distance H is not 0, this means the formation of a normal fold, and as illustrated in FIG. 3B, if a fold forms from the crown cap upper surface, the crown cap shoulder coincides with the starting point of the fold ridge, the vertical distance H is 0, and it is determined that a defective fold has formed. The fold starting point depth H was measured for all 21 folds, and samples with a shape defect in which a fold formed from the crown cap upper surface were judged as "Poor", and samples with no such defects as "Good". The evaluation results are liset in Table 3.

The impact resistance of crown caps was evaluated by a drop impact test using the formed crown caps. That is, a commercial beer was poured into a commercial bottle, then the bottle was plugged with a formed crown cap and stirred for 1 minute, inclined by 20°, then a ball of 500 g of hard polyvinyl chloride was freely dropped from a height of 1 m above to the crown cap, and leakage of beer was checked. Drop impact test was performed on five bottles plugged with five crown caps formed from respective steel sheets. This test was conducted for each steel sheet, and the impact resistance was judged "Excellent" for crown caps with zero beer leaks as being particularly excellent, "Good" for crown caps with one beer leak as being equivalent to that of the conventional crown cap, or "Poor" for crown caps with two or more beer leaks as being inferior to that of the conventional crown cap. The evaluation results are listed in Table 3. In addition, the conventional crown cap used as a reference was a crown cap formed using a mild steel having a thick of 0.22 mm.

In addition, each of the obtained steel sheets was subjected to heat treatment corresponding coating and baking at 210° C. for 15 minutes, then formed into a DRD can, and the DRD can formability was evaluated. That is, a circular blank with a diameter of 158 mm was subjected to drawing and redrawing to form a DRD can having an inner diameter of 82.8 mm and a flange diameter of 102 mm, and the DRD can formability was evaluated. In the evaluation, samples were judged as "Poor" if the number of fine wrinkles visually observed in the flange portion was three or more, or "Good" if the number of such fine wrinkles was two or less. The results are listed in Table 3.

Figure 4A:
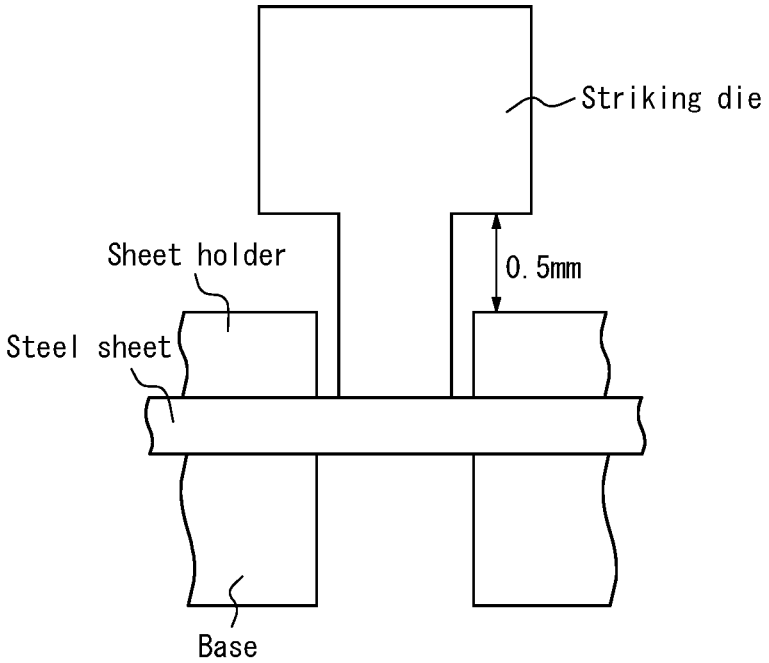
FIGS. 4A and 4B illustrate the procedure of an impact resistance test performed on a DRD can.
Figure 4B:
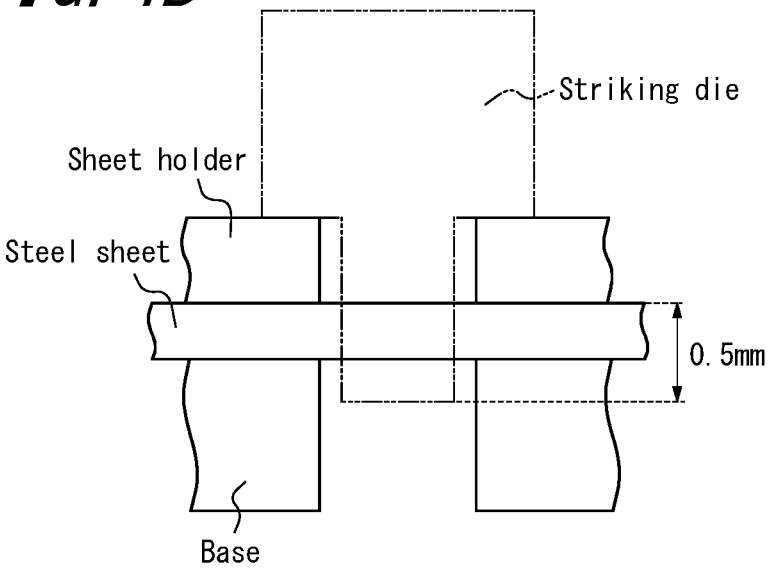
Figure 5A:
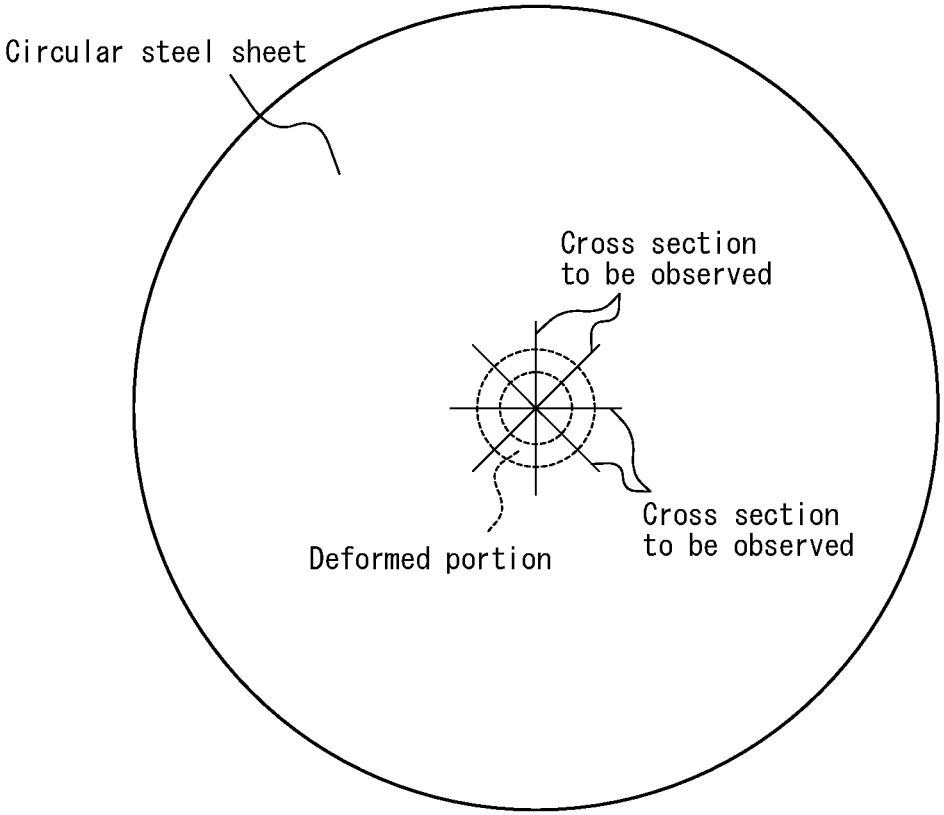
FIGS. 5A and 5B illustrate an evaluation target of an impact resistance test performed on a DRD can.
Figure 5B:
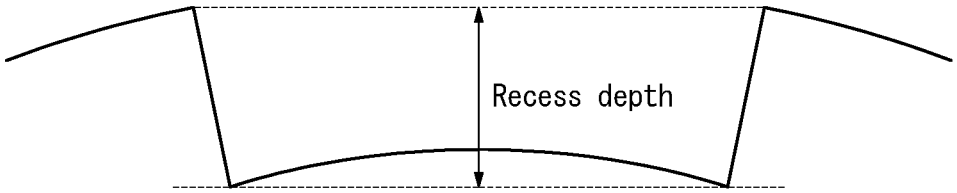

Furthermore, the impact resistance of DRD cans was evaluated. From the bottom of each DRD can, a circular steel sheet of 45 mm in diameter was cut out and subjected to an impact resistance test. The striking die had a diameter of 12.7 mm and a flat bottom, and the base and the sheet holder were provided with circular holes having a diameter of 13.5 mm. The positional relationship between the striking die, the base, the sheet holder, and the circular steel sheet, as illustrated in FIG. 4, is such that the holes of the striking die and the base, the hole of the sheet holder, and the center of the circular steel sheet are aligned, and the bottom of the striking die can be pushed downward by 0.5 mm. In a state where the circular steel sheet was unmovably fixed by a sheet holder, a weight of 500 g was dropped onto the striking die from a height of 50 cm, and the circular steel sheet was deformed upon impact. The 3D shape of the deformed portion was measured using a 3D shape measuring machine VR-3000 made by Keyence, and as illustrated in FIG. 5, the average value of recess depths at four cross sections of the deformed portion was evaluated as the recess depth of the steel sheet. The impact resistance was judged "Excellent" as being particularly excellent when the recess depth was less than 650 μm, "Good" when the recess amount was 650 μm or more and less than 700 μm as being equivalent to that of the conventional DRD can, or "Poor" when the recess amount was 700 μm or more as being inferior to that of the conventional DRD can. The evaluation results are listed in Table 3. The conventional DRD can used as a reference was a DRD can formed using a mild steel having a thickness of 0.22 mm.

shape defects in which wrinkles form in the flange portion, and the recess amount in the impact resistance test was comparable to or better than conventional DRD cans, and excellent formability and impact resistance were obtained.

On the other hand, in the steel sheets of comparative examples which fall outside the disclosed range, the dislocation density at a depth position of ½ of the sheet thickness from the surface in the sheet thickness direction was less than $2.0\times10^{14}/m^2$ or greater than $1.0\times10^{15}/m^2$, and the crown caps and DRD cans formed using the sheet sheets of the comparative examples were inferior in either formability or impact resistance.

For No. 3, the slab heating temperature in the hot rolling step was less than 1200° C. out of the disclosed range, and the dislocation density at a depth position of ½ of the sheet thickness from the surface in the thickness direction was less

TABLE 3

| No. | Steel | Steel sheet microstructure Dislocation density at a depth positon of ½ of the sheet thickness from the surface ($\times10^{14}/m^2$) | Crown cap Formability | Crown cap Impact resistance | DRD can Formability | DRD can Impact resistance | Remakrs |
|---|---|---|---|---|---|---|---|
| 1 | A | 2.3 | Good | Good | Good | Good | Example |
| 2 | A | 2.9 | Good | Good | Good | Good | Example |
| 3 | A | 1.1 | Good | Poor | Good | Poor | Comparative example |
| 4 | B | 6.9 | Good | Excellent | Good | Excellent | Example |
| 5 | B | 6.2 | Good | Excellent | Good | Excellent | Example |
| 6 | B | 2.9 | Good | Good | Good | Good | Example |
| 7 | B | 12.2 | Poor | Good | Poor | Good | Comparative example |
| 8 | B | 1.3 | Good | Poor | Good | Poor | Comparative example |
| 9 | C | 2.6 | Good | Good | Good | Good | Example |
| 10 | C | 8.3 | Good | Excellent | Good | Excellent | Example |
| 11 | C | 7.9 | Good | Excellent | Good | Excellent | Example |
| 12 | C | 1.4 | Good | Poor | Good | Poor | Comparative example |
| 13 | C | 1.3 | Poor | Poor | Poor | Poor | Comparative example |
| 14 | D | 9.2 | Good | Excellent | Good | Excellent | Example |
| 15 | D | 7.1 | Good | Excellent | Good | Excellent | Example |
| 16 | D | 2.7 | Good | Good | Good | Good | Example |
| 17 | D | 1.8 | Good | Poor | Good | Poor | Comparative example |
| 18 | E | 6.9 | Good | Excellent | Good | Excellent | Example |
| 19 | E | 6.6 | Good | Excellent | Good | Excellent | Example |
| 20 | E | 1.6 | Good | Poor | Good | Poor | Comparative example |
| 21 | F | 2.9 | Good | Good | Good | Good | Example |
| 22 | F | 2.8 | Good | Good | Good | Good | Example |
| 23 | F | 2.6 | Good | Good | Good | Good | Example |
| 24 | G | 1.3 | Good | Poor | Good | Poor | Comparative example |
| 25 | H | 11.3 | Poor | Good | Poor | Good | Comparative example |
| 26 | I | 1.4 | Good | Poor | Good | Poor | Comparative example |
| 27 | J | 10.7 | Poor | Good | Poor | Good | Comparative example |
| 28 | K | 6.3 | Poor | Good | Poor | Good | Comparative example |
| 29 | L | 8.1 | Poor | Good | Poor | Good | Comparative example |
| 30 | M | 7.2 | Poor | Good | Poor | Good | Comparative example |
| 31 | N | 1.8 | Good | Poor | Good | Poor | Comparative example |
| 32 | O | 5.3 | Poor | Good | Poor | Good | Comparative example |
| 33 | P | 1.9 | Good | Poor | Good | Poor | Comparative example |
| 34 | Q | 2.8 | Good | Good | Good | Good | Example |
| 35 | R | 1.7 | Good | Poor | Good | Poor | Comparative example |
| 36 | S | 2.7 | Poor | Good | Poor | Good | Comparative example |

*Underlined if outside of the scope of the disclosure.

From Table 3, each of the steel sheets of our examples had a dislocation density of $2.0\times10^{14}/m^2$ or more and $1.0\times10^{15}/m^2$ or less at a depth position of ½ of the sheet thickness from the surface in the sheet thickness direction. The crown cap formed by using the steel sheet disclosed herein did not have a shape defect in which a fold forms from the crown cap upper surface, and the beer leakage results in the drop impact test were comparable to or better than that of the conventional crown cap. In addition, the DRD cans formed using the steel sheet disclosed herein did not suffer from than $2.0\times10^{14}/m^2$ out of the disclosed range, and the impact resistance was inferior to that of the conventional crown cap and DRD can.

For No. 7, the rolling reduction in the secondary cold rolling step was over 40% outside the disclosed range, and the dislocation density at a depth position of ½ of the sheet thickness from the surface in the sheet thickness direction was more than $1.0\times10^{15}/m^2$ out of the disclosed range, and a shape defect occurred in which a fold formed from the crown cap upper surface during crown cap formation, a shape defect occurred in which wrinkles formed in the flange portion during DRD can formation, and the formability was inferior to that of the conventional crown cap and DRD can.

For No. 8, the coiling temperature in the hot rolling step exceeded 670° C. out of the disclosed range, and the dislocation density at a depth position of ½ of the sheet thickness from the surface in the thickness direction was less than $2.0\times10^{14}/m^2$ out of the disclosed range, and the impact resistance was inferior to that of the conventional crown cap and DRD can. For No. 12, the average tension between cold rolling stands in the secondary cold rolling step was less than 98 MPa out of the disclosed range, and the dislocation density at a depth position of ½ of the thickness from the surface in the thickness direction was less than $2.0\times10^{14}/m^2$ out of the disclosed range, and the impact resistance was inferior to that of the conventional crown cap and DRD can.

For No. 13, the annealing temperature in the annealing step was lower than 650° C., the dislocation density at a depth position of ½ of the sheet thickness from the surface in the thickness direction was less than $2.0\times10^{14}/m^2$ out of the disclosed range, non-recrystallized microstructures exceeded 5%, a shape defect occurred in which a fold formed from the crown cap upper surface during crown cap formation, a shape defect occurred in which wrinkles formed in the flange portion during DRD can formation, and the impact resistance was inferior to that of the conventional crown cap and DRD can.

For No. 17, the annealing temperature in the annealing step was over 750° C., the dislocation density at a depth position of ½ of the sheet thickness from the surface in the thickness direction was less than $2.0\times10^{14}/m^2$ out of the disclosed range, and the impact resistance was inferior to that of the conventional crown cap and DRD can.

For No. 20, the rolling reduction in the secondary cold rolling step was less than 10%, the dislocation density at a depth position of ½ of the sheet thickness from the surface in the sheet thickness direction was less than $2.0\times10^{14}/m^2$ out of the disclosed range, and the impact resistance was inferior to that of the conventional crown cap and DRD can.

For No. 24, the C content was 0.006% or less, the dislocation density at a depth position of ½ of the sheet thickness from the surface in the thickness direction was less than $2.0\times10^{14}/m^2$ out of the disclosed range, and the impact resistance was inferior to that of the conventional crown cap and DRD can.

For No. 25, the C content was more than 0.012%, the dislocation density at a depth position of ½ of the thickness from the surface in the thickness direction exceeded $1.0\times10^{15}/m^2$ out of the disclosed range, a shape defect occurred in which a fold formed from the crown cap upper surface during crown cap formation, a shape defect occurred in which wrinkles formed in the flange portion during DRD can formation, and the formability was inferior to that of the conventional crown cap and DRD can.

For No. 26, the N content was less than 0.0080%, the dislocation density at a depth position of ½ of the sheet thickness from the surface in the thickness direction was less than $2.0\times10^{14}/m^2$ out of the disclosed range, and the impact resistance was inferior to that of the conventional crown cap and DRD can.

For No. 27, the N content was more than 0.0200%, the dislocation density at a depth position of ½ of the sheet thickness from the surface in the thickness direction exceeded $1.0\times10^{15}/m^2$ out of the disclosed range, a shape defect occurred in which a fold formed from the crown cap upper surface during crown cap formation, a shape defect occurred in which wrinkles formed in the flange portion during DRD can formation, and the formability is inferior to that of the conventional crown cap and DRD can.

For No. 28, the Si content was more than 0.02%, the formability of the steel sheet was reduced, a shape defect occurred in which a fold formed from the crown cap upper surface during crown cap formation, a shape defect occurred in which wrinkles formed in the flange portion during DRD can formation, and the formability was inferior to that of the conventional crown cap and DRD can.

For No. 29, the Mn content was more than 0.60%, the formability of the steel sheet was reduced, a shape defect occurred in which a fold formed from the crown cap upper surface during crown cap formation, a shape defect occurred in which wrinkles formed in the flange portion during DRD can formation, and the formability was inferior to that of the conventional crown cap and DRD can.

For No. 30, the P content was more than 0.020%, the formability of the steel sheet was reduced, a shape defect occurred in which a fold formed from the crown cap upper surface during crown cap formation, a shape defect occurred in which wrinkles formed in the flange portion during DRD can formation, and the formability was inferior to that of the conventional crown cap and DRD can.

For No. 31, the Al content was more than 0.07%, the dislocation density at a depth position of ½ of the sheet thickness from the surface in the thickness direction was less than $2.0\times10^{14}/m^2$ out of the disclosed range, and the impact resistance was inferior to that of the conventional crown cap and DRD can.

For No. 32, the Al content was less than 0.01%, the formability of the steel sheet was reduced, a shape defect occurred in which a fold formed from the crown cap upper surface during crown cap formation, a shape defect occurred in which wrinkles formed in the flange portion during DRD can formation, and the formability was inferior to that of the conventional crown cap and DRD can.

For No. 33, the C content was 0.0060 or less, the dislocation density at a depth position of ½ of the sheet thickness from the surface in the thickness direction was less than $2.0\times10^{14}/m^2$ out of the disclosed range, and the impact resistance was inferior to that of the conventional crown cap and DRD can.

For No. 35, the Mn content was less than 0.10%, the dislocation density at a depth position of ½ of the sheet thickness from the surface in the thickness direction was less than $2.0\times10^{14}/m^2$ out of the disclosed range, and the impact resistance was inferior to that of the conventional crown cap and DRD can.

For No. 36, the S content was more than 0.20%, the formability of the steel sheet was reduced, a shape defect occurred in which a fold formed from the crown cap upper surface during crown cap formation, a shape defect occurred in which wrinkles formed in the flange portion during DRD can formation, and the formability was inferior to that of the conventional crown cap and DRD can.

The invention claimed is:

1. A steel sheet comprising:

a chemical composition containing, by mass %,

C: more than 0.006% and not more than 0.012%,

Si: 0.02% or less,

Mn: 0.10% or more and 0.60% or less,

P: 0.020% or less,

S: 0.020% or less,

Al: 0.01% or more and 0.07% or less, and

N: 0.0080% or more and 0.0200% or less, with the balance being Fe and inevitable impurities; wherein a dislocation density at a depth position of ½ of a sheet thickness from a surface of the steel sheet is $2.0\times10^{14}/m^2$ or more and $1.0\times10^{15}/m^2$ or less.

2. The steel sheet according to claim 1, having a thickness of 0.20 mm or less.

3. A crown cap made of the steel sheet as recited in claim 1.

4. A DRD can made of the steel sheet as recited in claim 1.

5. A method of manufacturing the steel sheet as recited in claim 1, comprising:

a hot rolling step of heating a steel raw material at 1200° C. or higher, finish rolling the steel raw material to obtain a hot rolled sheet, and then coiling the hot rolled sheet within a temperature range of 670° C. or lower;

a pickling step of pickling the hot rolled sheet after the hot rolling step;

a primary cold rolling step of cold rolling the hot rolled sheet after the pickling step to obtain a cold rolled sheet;

an annealing step of annealing the cold rolled sheet after the primary cold rolling step in a temperature range of 650° C. to 750° C. to obtain an annealed sheet; and a secondary cold rolling step of cold rolling the annealed sheet after the annealing step, with a rolling reduction of 10% or more and 30% or less and an average tension of 98 MPa or more between cold rolling stands in a rolling apparatus having at least two cold rolling stands.

6. A crown cap made of the steel sheet as recited in claim 2.

7. A DRD can made of the steel sheet as recited in claim 2.

8. A method of manufacturing the steel sheet as recited in claim 2, comprising:

a hot rolling step of heating a steel raw material at 1200° C. or higher, finish rolling the steel raw material to obtain a hot rolled sheet, and then coiling the hot rolled sheet within a temperature range of 670° C. or lower;

a pickling step of pickling the hot rolled sheet after the hot rolling step;

a primary cold rolling step of cold rolling the hot rolled sheet after the pickling step to obtain a cold rolled sheet;

an annealing step of annealing the cold rolled sheet after the primary cold rolling step in a temperature range of 650° C. to 750° C. to obtain an annealed sheet; and a secondary cold rolling step of cold rolling the annealed sheet after the annealing step, with a rolling reduction of 10% or more and 30% or less and an average tension of 98 MPa or more between cold rolling stands in a rolling apparatus having at least two cold rolling stands.

* * * * *